United States Patent [19]

Yokota et al.

[11] Patent Number: 4,730,805

[45] Date of Patent: Mar. 15, 1988

[54] FORM FOR FORMING CONCRETE

[75] Inventors: Takayoshi Yokota, Tokyo; Shigekazu Horiya; Kenjiroh Tanaka, both of Kanagawa, all of Japan

[73] Assignee: Kabushiki Kaisha Kumagaigumi, Fukui, Japan

[21] Appl. No.: 863,565

[22] Filed: May 15, 1986

[30] Foreign Application Priority Data

May 28, 1985 [JP] Japan ..... 60-115139
May 28, 1985 [JP] Japan ..... 60-079781[U]
Jul. 3, 1985 [JP] Japan ..... 60-101467[U]

[51] Int. Cl.[4] ..... E04G 9/10; B28B 7/36

[52] U.S. Cl. ..... 249/113; 249/141; 249/189; 264/86

[58] Field of Search ..... 249/141, 189, 112, 113, 249/114; 425/84, 85, 812; 264/86, 87, 102

[56] References Cited

U.S. PATENT DOCUMENTS

| | | | |
|---|---|---|---|
| 2,321,277 | 6/1943 | Boyle | 425/85 |
| 2,349,469 | 5/1944 | Sloan | 210/347 |
| 2,474,721 | 6/1949 | Billner | 425/85 |
| 2,671,940 | 3/1954 | Billner | 425/85 |
| 2,688,175 | 9/1954 | Billner | 425/85 |
| 3,600,771 | 8/1971 | Dyrander | 425/85 |
| 3,844,527 | 10/1974 | Scott | 249/189 |
| 4,203,714 | 5/1980 | Wenander | 425/85 |

FOREIGN PATENT DOCUMENTS

| | | | |
|---|---|---|---|
| 52-137136 | 11/1977 | Japan . | |
| 60-43528 | 3/1985 | Japan . | |
| 735451 | 8/1955 | United Kingdom . | |
| 798091 | 7/1958 | United Kingdom . | |
| 1145499 | 3/1969 | United Kingdom . | |
| 2156416 | 10/1985 | United Kingdom . | |
| 486121 | 12/1975 | U.S.S.R. | 425/85 |

*Primary Examiner*—Jay H. Woo
*Assistant Examiner*—James C. Housel
*Attorney, Agent, or Firm*—Graybeal, Jensen & Puntigam

[57] ABSTRACT

A form for forming concrete comprises a first sheet permitting surplus water contained in the concrete cast in the form to pass through the first sheet, but capable of blocking the passage of the concrete, a second sheet secured to the first sheet, permitting the surplus water to be absorbed into it, and a plate secured to the second sheet. The first sheet provides paths for the surplus water by the existence of the second sheet. The paths for the surplus water are ensured by a spacer provided between the first sheet and the plate in lieu of the second sheet or together with the second sheet.

10 Claims, 19 Drawing Figures

FORM FOR FORMING CONCRETE

BACKGROUND OF THE INVENTION

1. Field of the Invention

This invention relates to a form for forming concrete.

2. Description of the Prior Art

It is an ideal that water content contained in concrete used for forming concrete formings of structures constituting buildings, constructions or the like is necessary and sufficient for hydration of cement contained in the concrete. However, since concrete with such water content is very low in fluidity, it does not reach all the corners of space wherein it is to be placed or cast. Thus, concrete containing surplus water unnecessary for hydration of cement is actually used.

A form for forming concrete with sheathing boards made of plastic, steel or wood to contact a space wherein the concrete is cast and thus said concrete is well known. Therefore, the concrete being cast in the space surrounded by said sheathing boards is cured under the condition containing the surplus water therein.

The concrete containing a great deal of the surplus water is developed relatively slow in initial strength after casting thereof so that concrete work is delayed. In addition, said cast concrete has a large contraction amount during drying thereof so that the formings are liable to have cracks, thereby arising such problems that high quality concrete formings excellent in durability and water tightness cannot be obtained.

Further, air in the form of bubbles is mixed in said concrete at the casting thereof. Some of these bubbles, however, ascend through the concrete naturally or by compaction while the concrete is still flowable to be ejected to the atmosphere, while some of the rest remain in the concrete and between the concrete and the sheathing boards to form cavities which also degrade the durability and water tightness of concrete formings.

Conventionally, a form which may exhaust the surplus water and bubbles from the cast concrete as much as possible has been proposed in order to solve such problems.

As disclosed in Japanese Patent Public Disclosure (KOKAI) No. 137136/1977 this form comprises a plate member provided with a plurality of through holes and one or more filter sheets bonded to said plate member, said filter sheets being made of such materials as to permit water to permeate therethrough, but block the permeation of cement grains or the like.

According to the form, a space wherein the concrete is to be cast is defined by said filter sheets, and when the concrete is cast in the space, the surplus water contained in the concrete and air mixed in said concrete during the casting thereof are exhausted to the outside of the form by way of said filter sheets and the through holes of said plate member.

Now, as described in said Japanese Patent Disclosure (KOKAI), in case of a single filter sheet, the filter sheet, or in case of a plurality of filter sheets, the inner most filter sheet contacting said plate member is respectively bonded to said plate member on portions except for said through holes, and a plurality of said filter sheets are further bonded to each other on portions except for the portions corresponding to said through holes.

Thus, the surplus water and air contained in the cast concrete are exhausted outside the form substantially through said holes which occupy a portion of the whole surface area of said filter sheet or said plate member and the filter sheet portions corresponding to the through holes so that an exhausted amount of said surplus water and air comes to be relatively small. Thus, the amount of said surplus water and air capable of being exhausted while the concrete is still flowable prior to hardening thereof is remarkably limited.

To reduce substantially the remaining water and air not exhausted, it is considered to increase the number of said through holes provided in said plate member. However, such increase in number of the through holes makes it difficult to permit said plate member to hold the strength capable of resisting a press force, i.e., lateral pressure exerted to said plate member by said cast concrete. Also, to obtain the plate member having more through holes and the strength capable of resisting said lateral pressure, a material of the plate member should have larger dimension or thickness and larger strength. However, the former causes increasing the weight of form which is preferably light and on the other hand the latter results in the rising cost of installation in concrete works necessary for the reduction of execution cost.

Also, in the Japanese Patent Public Disclosure (KOKAI) No. 43528/1985 is described a form in which a porous material having permeability and water absorbing property is applied to a metal plate. According to this form, the surplus water contained in the cast concrete is exhausted along said porous material to the outside of the form while air is ejected through the holes of said porous material to the atmosphere. Said porous material, however,comes to choke with adhesive used for applying said material to said metal plate, thereby causing flow paths for the surplus water and air to restrict and to reduce the exhausted amount of water and air.

SUMMARY OF THE INVENTION

Accordingly, an object of the present invention is to provide a form capable of exhausting a large amount of surplus water and air contained in the cast concrete for a short period of time without reducing the strength of a plate supporting a sheet or sheets and not requiring the plate of such qualities as being relatively large in thickness or particularly excellent in strength.

A form for forming concrete according to the present invention comprises a first sheet contacting the concrete being cast and permitting surplus water to pass through said first sheet, but blocking the passage of said concrete, a second sheet secured to said first sheet for permitting said surplus water to be absorbed thereinto and a plate secured to said second sheet.

According to the present invention, said first sheet provides paths for the surplus water being permeated into said first sheet through the cast concrete contacting said first sheet and air being introduced into said first sheet together with said surplus water. These paths are formed by structural gaps between a plurality of strings constituting a cloth when said first sheet is made of the cloth, gaps between a plurality of twisted yarns constituting said strings and fiber gaps between a plurality of fibers constituting said yarns to eject said surplus water and air to the outside of the form through these gaps.

Said first sheet, for example, is not impregnated with adhesive for fixing said first sheet to said plate, but said second sheet is impregnated with the adhesive. Thus, said gaps in said first sheet are not choked with the adhesive so that the whole first sheet and further the gaps between said first and second sheets may be utilized for the flow paths of said surplus water and air. Thus, a great deal of said surplus water and air may be exhausted for a short period of time.

Also, since the second sheet impregnated with said adhesive has relatively coarse structural density, said second sheet may be more easily impregnated with more adhesive. A great deal of the impregnated adhesives increases a holding force of said first sheet which said plate should possess and permit said first sheet to be more securely removed from the molded concrete surface at the removal of the form.

Further, the form according to the present invention comprises a spacer for defining paths for said surplus water and air having passed through said first sheet and/or said first and second sheets.

According to the present invention, the surplus water and air contained in the cast concrete having passed through said first sheet and/or said first and second sheets may be exhausted to the outside of the form through the paths of said spacer. The amount of said water and air flowing through said paths may be increased by reducing the contact area of said spacer with said first or second sheet, for example, increasing the number of holes, which forms part of said paths, in said spacer. Yet, the strengths of said plate is not reduced by this method.

Thus, the provision of paths for permitting relatively large amounts of the surplus water and air to flow between the plate and the cast concrete dispenses with any flow path for said surplus water and air in said plate and thus prevents the strength of the plate from degradation.

BRIEF DESCRIPTION OF THE DRAWINGS

The other objects and features of the invention will become more apparent from the following description of preferred embodiments of the invention with reference to the accompanying drawings, in which.

DESCRIPTION OF THE PREFERRED EMBODIMENTS

Figure 1:
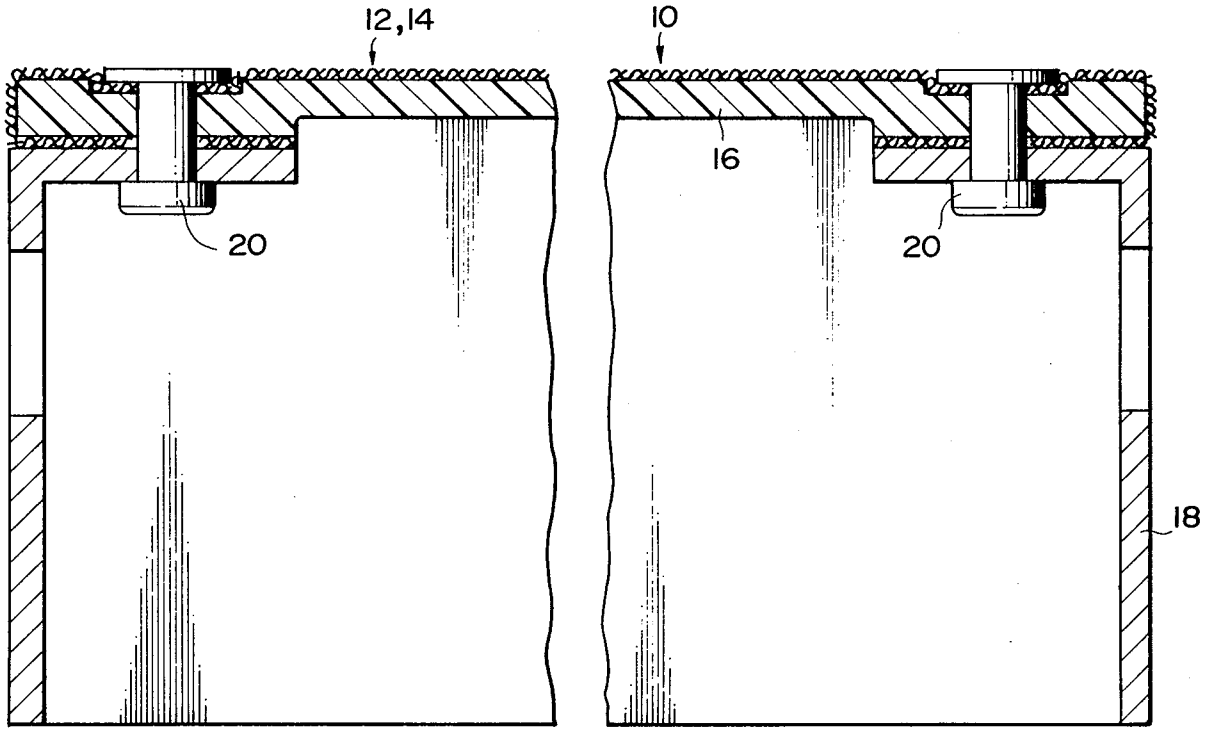
FIG. 1 is a cross-sectional view showing a form according to the present invention.
Figure 2:
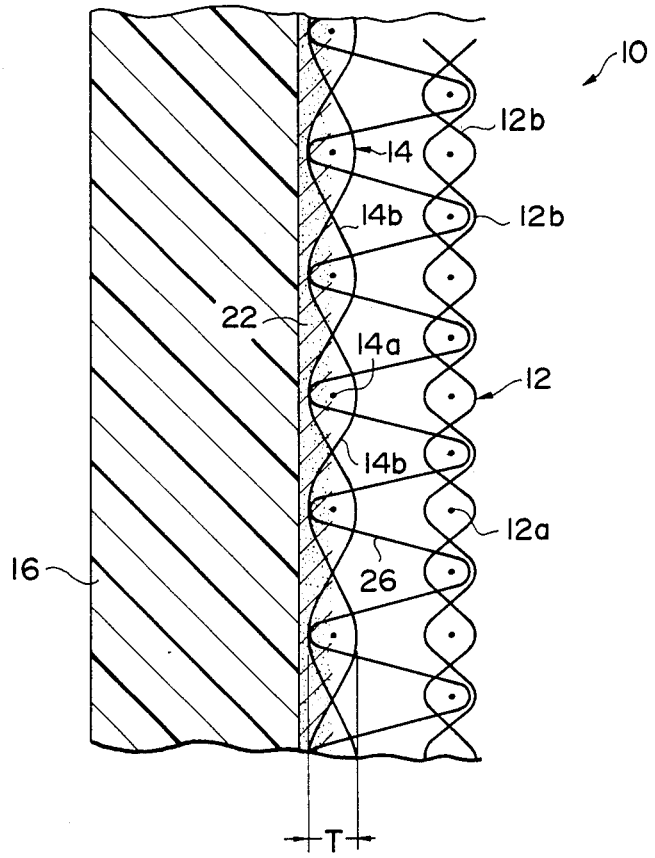
FIG. 2 is an enlarged-scale fragmentary sectional view of the form shown in FIG. 1.

Referring to FIGS. 1 and 2, a form 10 according to the present invention comprises a first sheet 12 contacting concrete (not shown) to be placed or cast, a second sheet 14 secured to the first sheet and a plate 16 secured to the second sheet.

A plurality of forms 10 are used by joining vertically and laterally so as to define at least one wall of concrete moldings to be molded, for example, the wall of a building. To interconnect the forms 10, a frame-like template 18 is placed on one surface of the plate 16 opposite to the other surface where said first and second sheets 12, 14 are disposed thereon. The template 18 is fixed to the plate 16 by means of a plurality of rivets 20 penetrating the first sheet 12, second sheet 14, plate 16 and template 18. A secured body of the first and second sheets 12, 14 secured to each other and having an area larger than that of the plate 16 is bent at the peripheral edge of the plate 16 and said peripheral edge is sandwiched between the plate 16 and the template 18. The plate 16 and the template 18 may be made of glass fiber reinforced plastic (FRP) and iron materials for example respectively. The plate 16 may be made of synthetic resin materials.

The concrete to be cast in used under such condition as to contain water of more than necessary amount for hydration of cement, i.e., surplus water so as to reach all the corners of a space defined overall or partially by the first sheet 12 for casting. Also, when the concrete is cast into said space, air in the form of bubbles is mixed in said cast concrete. The surplus water and air degrade the quality of concrete moldings.

While the first sheet 12 permits said surplus water contained in the concrete contacting said sheet to pass therethrough, it can be made of a cloth as shown in the drawing or nonwoven fabric (not shown) which blocks the passage of the concrete. According to the present invention, "the sheet permits the surplus water to pass therethrough, but blocks the passage of the concrete" means as follows: The sheet permits cement grains or other fine particles leaching through unhardened concrete together with said surplus water to pass through the sheet, but blocks the passage of the concrete, i.e., grains containing cement, water necessary for hydration of said cement and aggregates or the like, after the completion of exhausting the surplus water. Said cloth, nonwoven fabric or the like is preferably made of synthetic fiber having high alkali resistance, water resisting property, weather resisting property and relatively high tensile strength.

The second sheet 14 is secured to the first sheet 12 on one surface and secured to the plate 16 on the other surface by way of adhesive 22 such as those made of synthetic resin to permit said surplus water coarser than meshes of the first sheet 12 to impregnate said sheet 14. The second sheet 14 may be constituted of cloth made of synthetic fibers similar to the first sheet 12. In case where the second sheet 14 is made of synthetic fiber and the plate is made of synthetic resin material, either one of the surfaces thereof is fused with heat treatment, and press fitted during the fusion to bond them with each other in lieu of said adhesive. By making the second sheet 14 of cloth having coarse meshes, i.e., large structural gaps between weft 24*a* and warp 24*b* in the embodiment shown may be easily impregnated the second sheet 14 with a great amount of adhesive. This increases adhesion between the plate 16 and the second sheet 14 and thus binding force between the first sheet 12 and the plate 16. Thus, when the form is separated from the concrete by removing the first sheet 12 from the concrete molding, the first sheet 12 may be prevented from exfoliation from the plate 16. The adhesives 22 is desirably allowed to be impregnated up to a half of the thickness T of the second sheet 14.

The first and second sheets 12, 14 may be secured to each other by way of strings 26 made of synthetic fibers having relatively high tensile strength for example.

The surplus water leaching through the concrete being cast in said space and contacting the first sheet 12 and air contained in the surplus water permeate in the first sheet 12. However, concrete, i.e., mixed grains containing cement, aggregates, water necessary for hydration of cement or the like, is blocked from permeation into the first sheet 12 to remain in said cast space. Also, some of the surplus water and air permeating in the first sheet 12 are introduced further into the gap between the first and second sheets 12, 14 by way of the first sheet 12 and furthermore into the second sheet 14 in case where the second sheet 14 is not completely impregnated with said adhesive.

Said surplus water and air permeated in the first sheet 12, the gap between the first and second sheets 12, 14 and the second sheet 14 are respectively flowable below and above the form 10 under the action of gravity. More particularly, the surplus water and air permeated in said cloth constituting the first sheet 12 are allowed to flow through the structural gaps between a plurality of warps 12*b* (or wefts 12*a*) of the cloth, yarn gaps between a plurality of yarns (not shown) constituting these warps and wefts and fiber gaps between a plurality of fibers constituting said yarns. These situations apply similarly to the surplus water and air permeating in the second sheet 14 made of cloth.

Said gaps in the first sheet 12 providing paths for said surplus water and air exist throughout the first sheet and in addition, since said gaps exist in the second sheet 14 and between the first and second sheets 12, 14, a great amount of surplus water and air may flow into the gaps and thus be exhausted to the outside of the form for a short period of time.

By the exhaustion of the surplus water is reduced the water-cement ratio of concrete so that the development of initial strength of concrete is promoted. As a result, the form may be removed earlier from the concrete to shorten a term of concrete works. Also, the degree of reduction of said water-cement ratio is the most remarkable on the concrete surface contacting the first sheet 12 so that concrete moldings having an extremely hard surface are molded. Further, by said exhaustion of air is not produced so-called air pits on the surface of said concrete moldings. Further, since the first and second sheets 12, 14 act as an adiabatic material for the cast concrete, they contribute to the prevention of crack generation on the concrete surface due to the temperature difference during concrete works in winter, summer, high-land, mountainous regions or the like. also, air and water permeabilities and fluidity of the surplus water and air which the first sheet retains are not lost by uses of the form for a plurality of times. These functions or actions of the first and second sheets 12, 14 can be obtained similarly from embodiments which will be hereinafter described.

Figure 3:
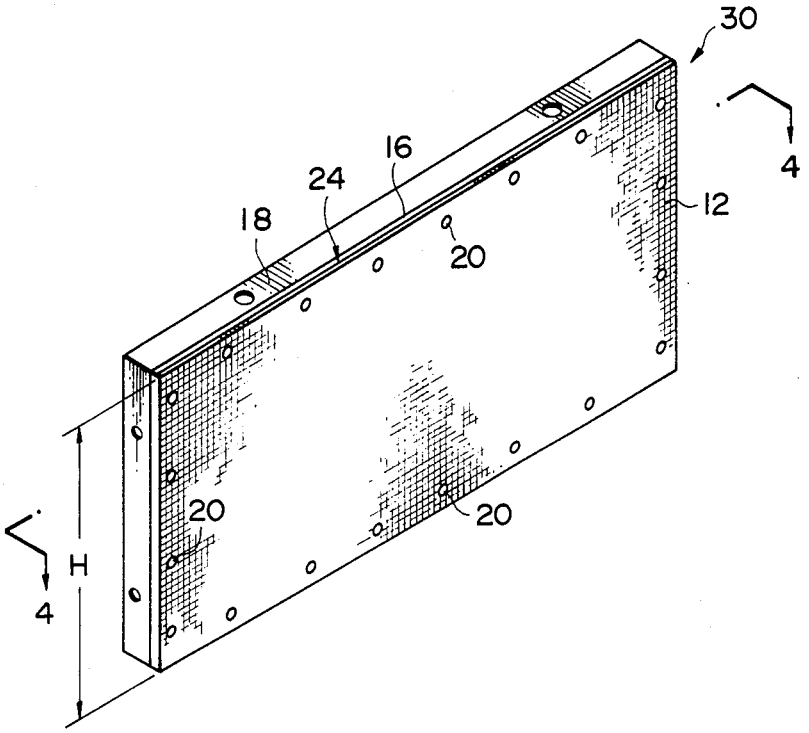
FIG. 3 is a perspective view showing the form having a spacer.
Figure 4:
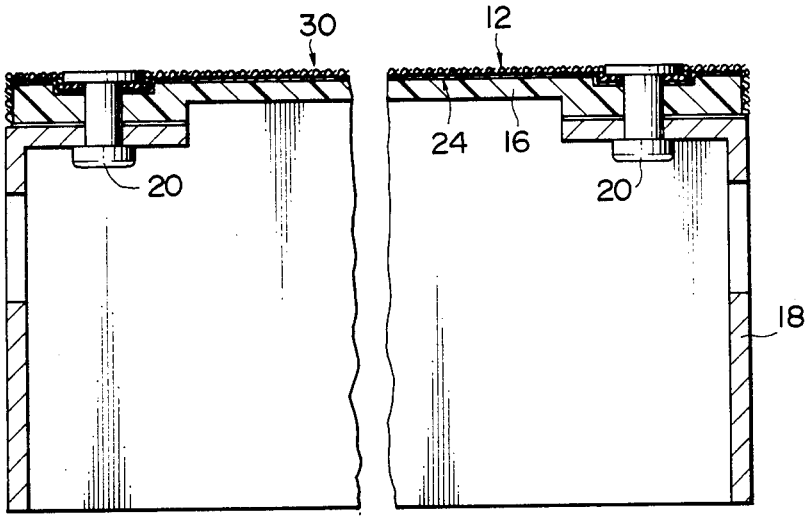
FIG. 4 is a cross-sectional view taken along the line 4—4 in FIG. 3.

FIGS. 3 and 4 show a form 30 having a spacer 24.

Figure 5:
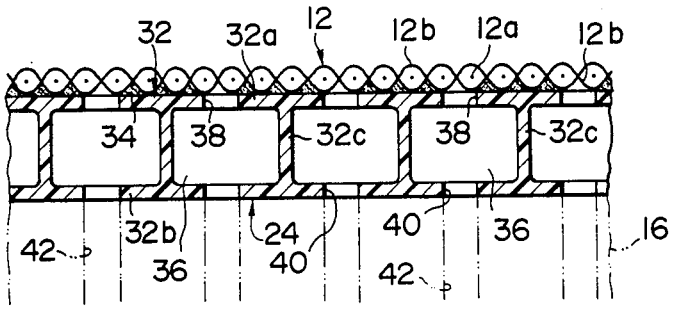
FIG. 5 is a an enlarged-scale fragmentary sectional view of the form shown in FIG. 3.

As shown in FIG. 5, the spacer 24 consists of a plate-like member 32 defining paths for said surplus water and air having passed through the sheet similar to said first sheet 12. The plate-like member 32 consists of a pair of parallel flat plate portions 32*a*, 32*b* and a partition wall portion 32*c* connected integrally with both flat portions, one flat plate portion 32*a* being secured to the first sheet 12 by way of adhesive 34 and the other flat plate portion 32*b* being secured to the plate 16 by way of adhesive (not shown). Also, one flat plate portion 32*a* is provided with holes 38 communicating to a space 36 surrounded by both flat plate portions and partition wall portions, having a rectangular cross-section and opening to the atmosphere, and defining said path with the space.

Similarly to said embodiment, the sheet 12, plate-like member 32, plate 16 and template 18 are attached to each other by way of a plurality of rivets 20 penetrating therethrough, provided the sheet 12 and plate-like member 32 have approximately same planar shape as the plate 16 and differ from said embodiment in the lamination of the registered peripheral edges. The form 30, in use, is preferably disposed so as to extend vertically the space 36 in the plate-like member for ensuring the smooth flow of said surplus water and air.

The surplus water and air contained in the concrete being cast in the space defined by the form 30 and contacting the sheet 12 permeate in a plurality of portions of the sheet 12 opposed to a plurality of holes 38 in the plate-like member 32, i.e., portions to which the adhesive 34 is not applied, and then are exhausted to the outside of the form 30 through said paths, i.e., the holes 38 and space 36. The amount of said surplus water and air received in said space 36 through said holes 38 substantially depends upon the opening area of all holes 38, i.e., the total area of portions of the sheet 12 opposed to these holes so that the exhaust amount of said surplus water and air may be increased by providing a great number of holes 38 each having relatively small bore. Further, by providing at least one hole 40 communicating to the space 36 in the other flat plate portion 32*b* of the plate-like member 32 and a hole 42 corresponding to said hole in the plate 16 to make said path portions of these holes can be exhausted some of said surplus water and air overflowing from said space 36 through these holes 40, 42. Therefore, more quantity of water and air can be exhausted, provided the provision of the holes 40, 42 is limited to the extent in which the plate 16 is capable of maintaining the required strength to be held.

The plate-like member 32 may be integrally molded with rigid materials or synthetic resin materials such as polyethylene, polypropylene, vinyl chloride and nylon like the embodiment shown in the drawing. The plate-like member 32 molded of said synthetic resin material is flexible and light. Thus, the bonding body having the sheet 12 applied to the plate-like member is wound or folded to carry in to construction and building fields where it is cut to conform to the size, planar shape or the like of variously dimensioned plates 16, thereby mounting it on the plate. Since the sheet 12 is previously bonded to the plate-like member 32, frays of strings of the sheet 12 due to the cut of these bonding bodies hardly take place. Also, since the sheet 12 is to be previously applied to the plate-like member 32 without any wrinkles, said bonding body may be easily rapidly and accurately placed on the plate 16 in said fields, compared with prior forms necessary for placing only the sheet on the plate.

Figure 6:
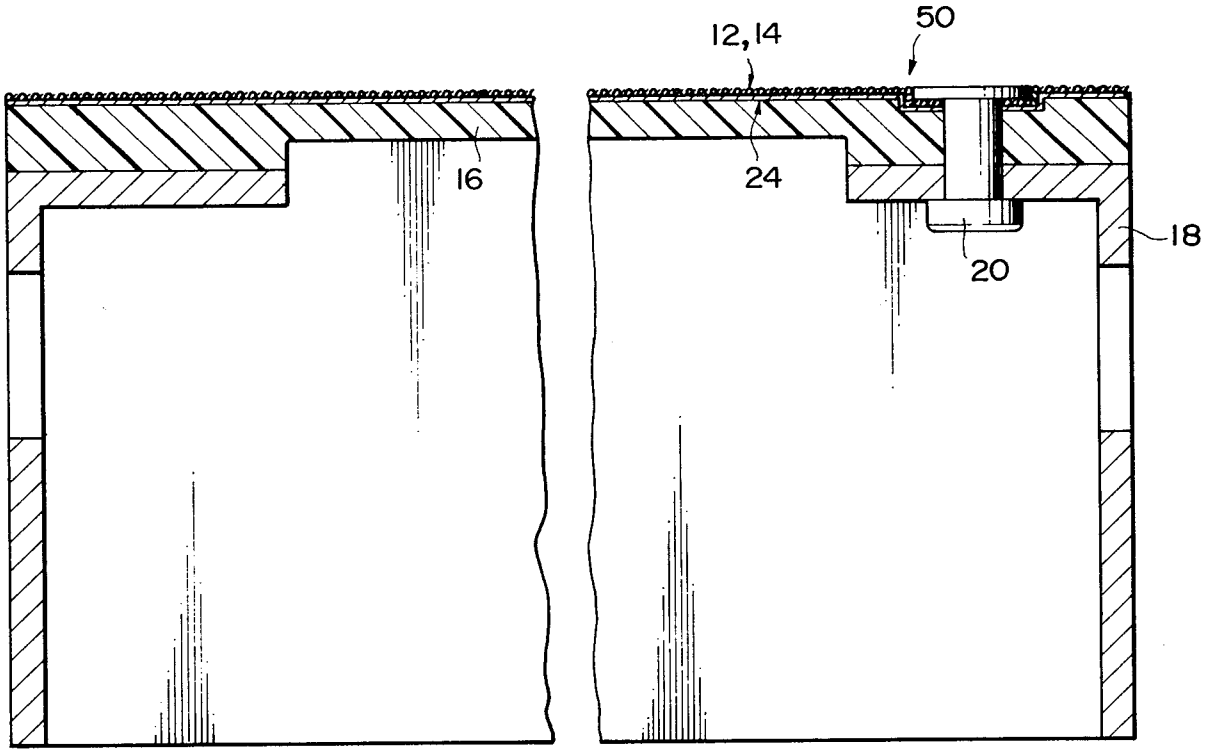
FIG. 6 is a cross-sectional view showing another embodiment of the form having the spacer.
Figure 7:
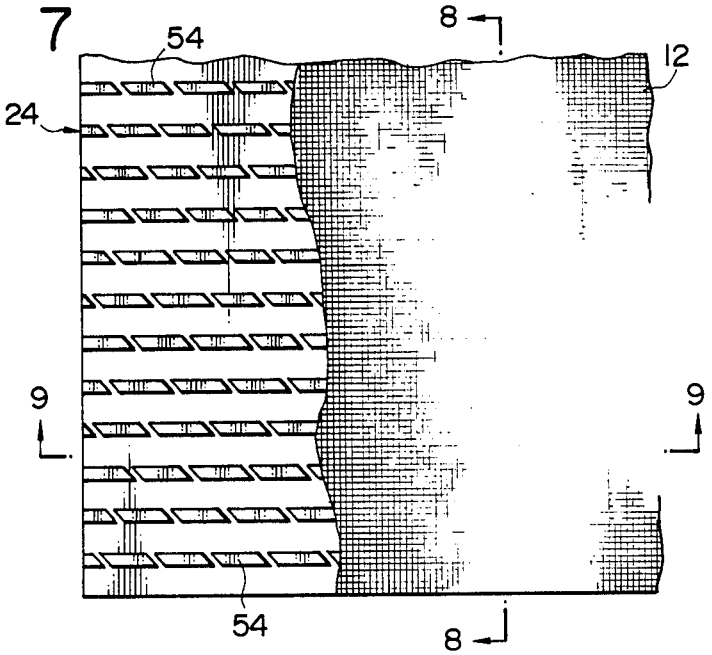
FIG. 7 is a fragmentary front view showing the spacer and a first sheet of the form shown in FIG. 6.
Figure 8:
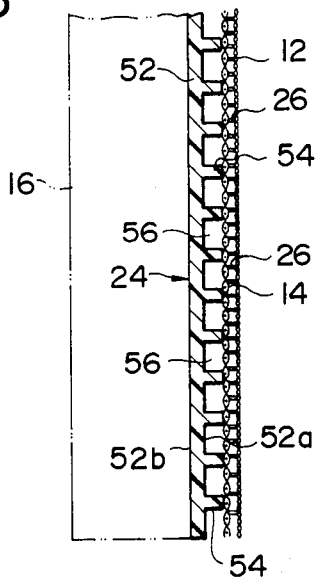
FIGS. 8 and 9 are cross-sectional views taken along the lines 8—8 and 9—9 in FIG. 7.
Figure 9:
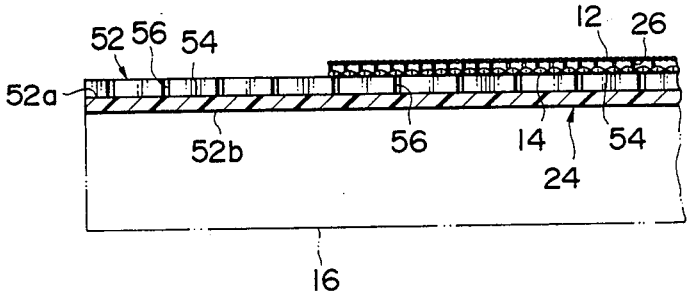

FIG. 6 further shows a form 50 having the spacer 24 of another embodiment defining said paths for said surplus water and air. As shown in FIGS. 7 to 9, the spacer 24 consists of a plate-like member 52. Said plate-like member 52 is bonded to the second sheet 14 secured to the first sheet 12 similar to one described above.

The second sheet 14, similarly to the embodiment shown in FIGS. 1 and 2, has meshes coarser than those of the first sheet 12. The first and second sheets 12, 14 may be secured to each other by way of strings 26 similar to said ones.

The plate-like member 52 may be formed of synthetic resin materials described in FIGS. 3 to 5 and one surface 52*a* thereof is formed with a plurality of lugs 54 spaced from each other and the second sheet 14 is bonded to the tops of the lugs. The second sheet 14 can be bonded to the plate-like member 52 by way of adhesive or by securing the second sheet 14 to the heat melted lugs 54.

The respective lugs 54 shown in the drawing have planar parallelogram shape and a plurality of lugs 54 are arranged laterally and longitudinally at predetermined intervals respectively.

In the spacer, a space 56 defined by one surface 52*a* of the plate-like member 52, second sheet 14 and a plurality of lugs 54 forms a path for said surplus water and air. In this embodiment, and further as described with reference to FIGS. 1 and 2, the structural gaps, yarn gaps and fiber gaps of the first sheet 12, gaps between the first and second sheets 12, 14 function as the paths for said surplus water and air. On the other hand, in case where the second sheet 14 is not completely impregnated with said adhesive or meltings of the lugs 54, the structural gaps, yarn gaps and fiber gaps of the second sheet 14 perform the same function.

Accordingly, some of the surplus water and air leaching through the cast concrete are exhausted through the paths consisting of said gaps related to the first and second sheets 12, 14 to the outside of the form 50 and the surplus water and air having passed through the first and second sheets 12, 14 are exhausted to the outside of the form 50 through the paths consisting of the space 56 related to the plate-like member 52. As a result, a great amount of surplus water and air leaching through said concrete are ensured to be exhausted.

Figure 10:
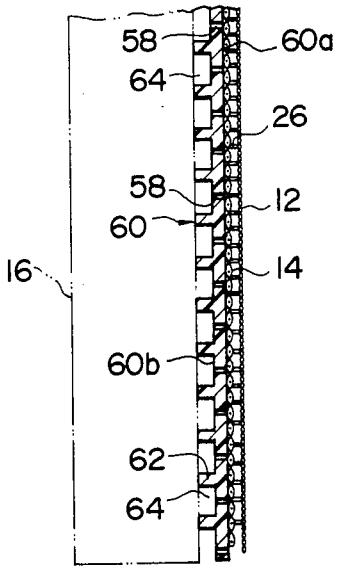
FIG. 10 is a cross-sectional view showing a modification of the spacer shown in FIG. 7.

FIG. 10 shows an embodiment of a plate-like member 60 employing the shape identical with the plate-like member 52 except for the provision of a plurality of holes 58. The plate-like member 60 has one surface 60*a* bonded to the second sheet 14 by way of adhesive and the other surface 60*b* bonded to the plate 16 on the tops of a plurality of lugs 62 formed on the other surface 60*b*. Respective holes 58 open to both surfaces 60*a*, 60*b*. In this embodiment, the space 64 defined by the plate 16, the other surface 60*b* of the plate-like member and lugs 62 and the holes 58 form the paths for said surplus water and air with respect to the plate-like member 60.

Said surplus water and air having reached the one surface 60*a* of the plate-like member by way of the first and second sheets 12, 14 are exhausted to the outside of the form through the holes 58 and the space 64.

FIGS. 11 to 19 show still further embodiment of the plate-like member made of said synthetic resin material and provided with lugs.

Figure 11:
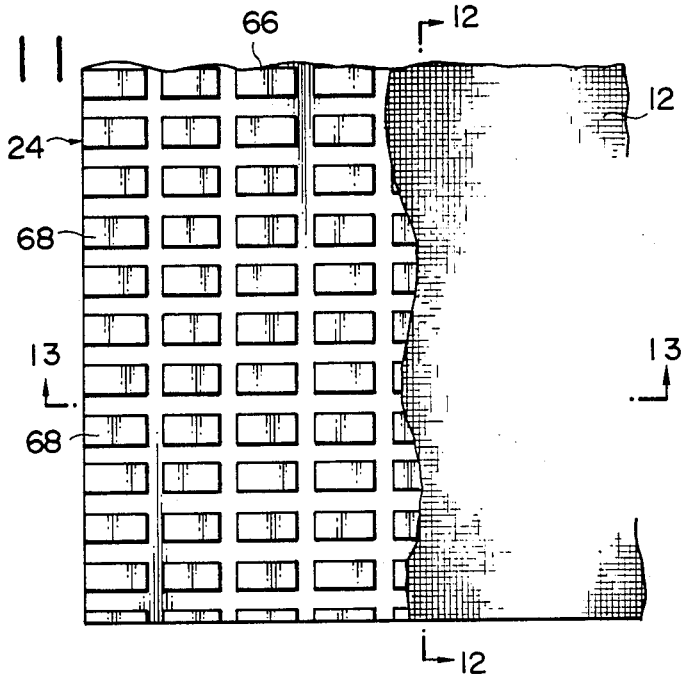
FIG. 11 is a fragmentary front view showing a further embodiment of the form having the spacer.
Figure 12:
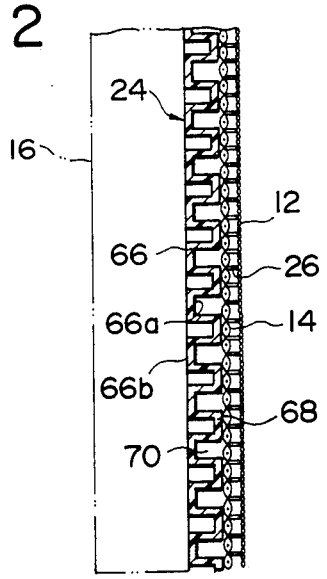
FIGS. 12 and 13 are cross-sectional views taken along the lines 12—12 and 13—13 in FIG. 11.
Figure 13:
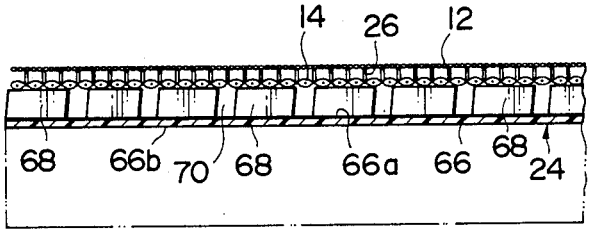

A plate-like member 66 shown in FIGS. 11 to 13 is formed with a plurality of planar parallelogram lugs 68 spaced from each other by embossing a plate material made of said synthetic resin material. The plate-like member 66 is bonded to the second sheet 14 on the tops of the lugs 68 formed on one surface 66*a* by way of adhesive and to the plate 16 on the other surface 66*b*.

In this embodiment, the paths for said surplus water and air related to the plate-like member 66 is formed of a space 70 defined by one surface 66*a* of the plate-like member 66, the second sheet 14 and the sides of lugs 68.

Figure 14:
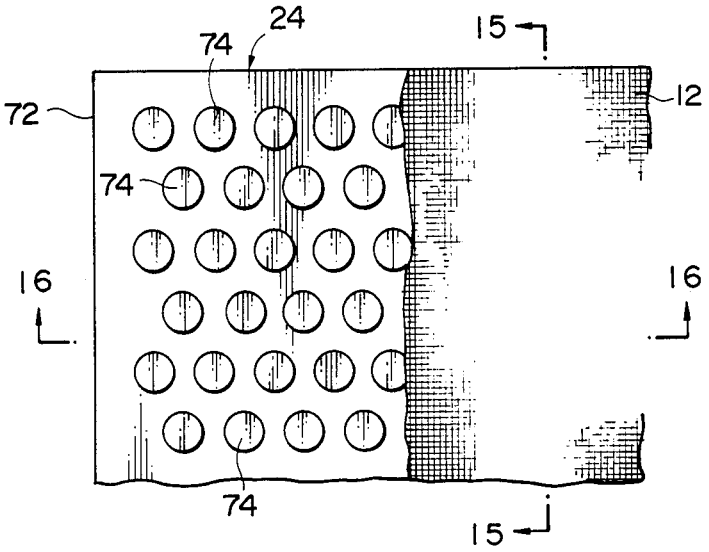
FIG. 14 is a fragmentary front view showing still a further embodiment of the form having the spacer.
Figure 15:
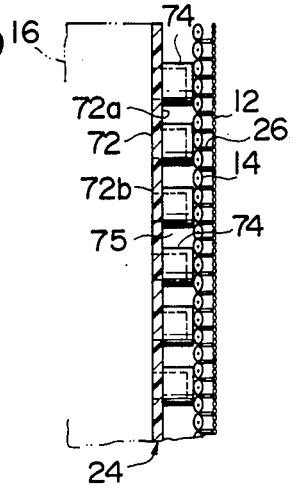
FIGS. 15 and 16 are cross-sectional views taken along the lines 15—15 and 16—16 in FIG. 14.
Figure 16:
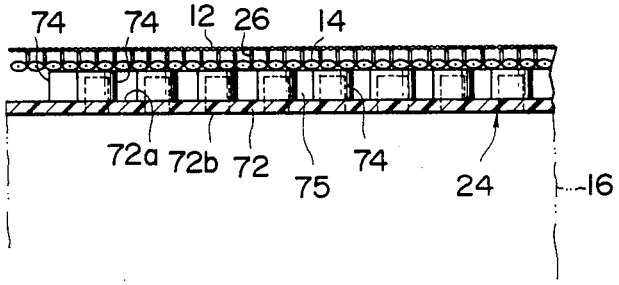

A plate-like member 72 shown in FIGS. 14 to 16 is formed with a plurality of short cylindrical lugs 74 spaced from each other by embossing a plate member made of said synthetic resin material.

The plate-like member 72 is bonded to the second sheet 14 on the tops of lugs 74 formed on one surface 72*a* by way of adhesive and to the plate 16 on the other surface 72*b*. The path for said surplus water and air related to the plate-like member 72 in this embodiment is formed of a space 75 defined by one surface 72*a* of the plate-like member 72, the second sheet 14 and the sides of the lugs 74.

Figure 17:
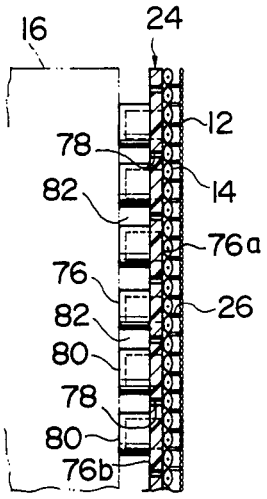
FIG. 17 is a cross-sectional view showing a modification of the spacer shown in FIG. 14.

A plate-like member 76 shown in FIG. 17 has the shape identical with said plate-like member 72 except for a plurality of holes 78.

The plate-like member 76 in this embodiment is bonded to the second sheet 14 on one surface 76*a* and to the plate 16 on the tops of a plurality of lugs 80 provided on the other surface 76*b* by way of adhesive respectively. Said path related to the plate-like member 76 is formed of a space 82 defined by the holes 78, plate 16, other surface 76*b* and lugs 80.

Figure 18:
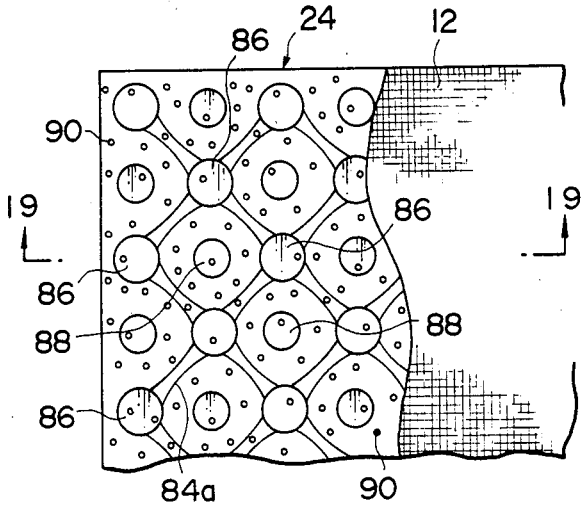
FIG. 18 is a fragmentary front view showing yet a further embodiment of the form having the spacer.
Figure 19:
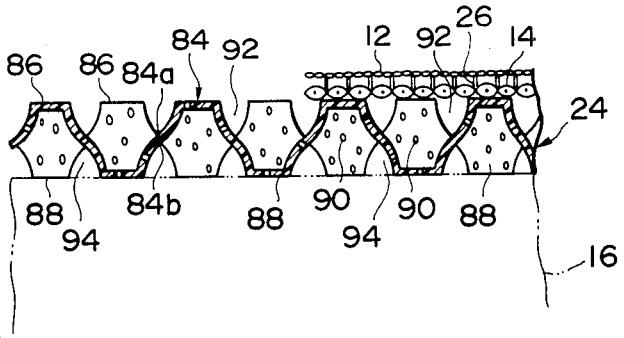
FIG. 19 is a fragmentary cross-sectional view taken along the line 19—19 in FIG. 18.

Further, a plate-like member 84 shown in FIGS. 18 and 19 is formed symmetrically on both surfaces 84*a*, 84*b* with a plurality of cup-like spaced lugs 86, 88 by embossing a plate member made of said synthetic resin material. The plate-like member 84 is also provided with a plurality of holes 90 opening to both surface sides thereof.

The plate-like member 84 is bonded to the second sheet 14 on the tops of lugs 86 at one side surface and to the plate 16 on the tops of lugs 88 at the other side surface by way of adhesive respectively. In this embodiment, said paths related to the plate-like member 84 are formed of portions of a space 92, a hole 90 and a space 94. The space 92 is defined by the second sheet 14, one surface 84*a* and lugs 86 and the space 94 defined by the plate 16, other surface 84*b* and lugs 88.

The paths defined by the plate-like member shown in FIGS. 6 to 19 differ from the embodiment shown in FIGS. 3 to 5 in the non-directional properties so that the disposal direction of the spacer 24 relative to the plate 16 and the installation direction of the form in molding the concrete are not limited. Also, said plate-like member may be formed of a rigid member instead of the embodiment shown in the drawing.

Further, in all said embodiments, the plate 16 may be made of metal or wood instead of FRP.

What is claimed is:

1. A form for forming concrete, comprising:

a first sheet permitting surplus water in concrete cast in said form to pass through said first sheet, but capable of blocking the passage of said concrete;

a second sheet secured to said first sheet and permitting said surplus water to be absorbed into said second sheet;

a spacer secured to said second sheet; and a plate secured to said spacer;

said spacer having on at least one surface a plurality of lugs spaced from each other, and defining paths for said surplus water having passed through said first and second sheets.

2. A form for forming concrete as claimed in claim 1, wherein said spacer comprises a planar member having on one surface a plurality of lugs spaced from each other, and having an opposite surface bonded to said plate, said second sheet being bonded to top portions of the lugs of said planar member.

3. A form for forming concrete as claimed in claim 1, wherein said spacer comprises a planar member having one surface bonded to said second sheet, having on an opposite surface a plurality of lugs spaced from each other, and having a plurality of holes opened to both surfaces, said plate being bonded to top portions of the lugs of said planar member.

4. A form for forming concrete as claimed in claim 1, wherein said spacer comprises a planar member having on one surface a plurality of first lugs spaced from each other, having on an opposite surface a plurality of second lugs spaced from each other, and having a plurality of holes opened to both sides, said second sheet being bonded to top portions of the plurality of first lugs of said planar member, and said plate being bonded to top portions of the plurality of second lugs of said planar member.

5. A form for forming concrete as claimed in claim 2, wherein said planar member is made of synthetic resin so as to have a degree of flexibility.

6. A form for forming concrete as claimed in claim 3, wherein said planar member is made of synthetic resin so as to have a degree of flexibility.

7. A form for forming concrete as claimed in claim 4, wherein said planar member is made of synthetic resin so as to have a degree of flexibility.

8. A form for forming concrete as claimed in claim 1, wherein said first and second sheets are respectively made of cloth.

9. A form for forming concrete as claimed in claim 8, wherein said cloth is made of synthetic fiber.

10. A form for forming concrete as claimed in claim 8, wherein said first and second sheets are secured to each other by way of strings.

* * * * *